US006308040B1

(12) United States Patent
Mizuno

(10) Patent No.: US 6,308,040 B1
(45) Date of Patent: Oct. 23, 2001

(54) ELECTROPHOTOGRAPHIC RECORDED DEVICE HAVING EXCELLENT SEPARATING CAPABILITIES AND METHOD OF TRANSFERRING THE RECORDED MEDIUM

(75) Inventor: Tsuneo Mizuno, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/544,901

(22) Filed: Apr. 7, 2000

(30) Foreign Application Priority Data

Sep. 1, 1999 (JP) ..... 11-247266

(51) Int. Cl.[7] ..... G03G 15/00
(52) U.S. Cl. ..... 399/388
(58) Field of Search ..... 399/315, 388, 399/390, 397, 398

(56) References Cited

U.S. PATENT DOCUMENTS 3,620,615 * 11/1971 Volkers ..... 399/315
3,851,230 * 11/1974 Okamoto et al. ..... 399/390 X
5,140,375 * 8/1992 Shindo et al. ..... 399/388 X
5,276,491 * 1/1994 Fuma et al. ..... 399/315
5,526,106 * 6/1996 Katsumi et al. ..... 399/315
5,822,666 * 10/1998 Haneda et al. ..... 399/390 X

* cited by examiner

*Primary Examiner*—Fred L. Braun
(74) *Attorney, Agent, or Firm*—Armstrong, Westerman, Hattori, McLeland & Naughton, LLP

(57) ABSTRACT

The electrophotographic recording device and method of transferring the recorded medium provide excellent separating capabilities. The electrophotographic recording device has a separator section located along a feed path of printing paper at a front stage of the transfer roller. At the separator section, the printing paper is dielectrically polarized to make its surface facing a photosensitive drum charged in the same polarity as that of the photosensitive drum before the printing paper is brought into contact with the photosensitive drum. The paper is separated from the photosensitive drum after the transfer process due to the electrostatic repulsion on a contact surface between the photosensitive drum and the paper.

12 Claims, 3 Drawing Sheets

ELECTROPHOTOGRAPHIC RECORDED DEVICE HAVING EXCELLENT SEPARATING CAPABILITIES AND METHOD OF TRANSFERRING THE RECORDED MEDIUM

BACKGROUND OF THE INVENTION

The present invention relates generally to recorded devices, and more particularly to an electrophotographic recorded device. The present invention is suitable, for example, to an electrophotographic printer. The "electrophotographic recorded device", which is typified by a laser printer, denotes a nonimpact printer that toner onto a latent image that has been formed on a photosensitive drum by laser for exposure, and then transfers the toner image onto a printing paper, thereby forming an image. The inventive recorded device is widely applicable not only to a discrete printer, but also to a photocopier, a facsimile unit, a computer system, a word processor, and a combination machine thereof each having a printing function.

An electrophotographic printer is one example of the electrophotographic recorded devices, which has been developed in recent years as a desktop type that provides the easy setup in an office. The electrophotographic printer has characteristics such as an excellent operability, wide range of acceptable media, and cost efficiency. It also provides a high-quality print output, and is thus expected to achieve a higher quality and higher speed of printing.

The electrophotographic printer generally includes a photosensitive drum and a transfer unit having a transfer roller. The printing paper as a recorded medium passes through between the photosensitive drum and the transfer roller. The photosensitive drum is uniformly negatively charged by a pre-charger, and an area on which toner is to be deposited is discharged by laser (exposure to light) to form a latent image. Subsequently, a development device makes charged toner adsorbed into the discharged area through a development roller, and forms a toner image. The transfer unit absorbs and attaches onto the printing paper the toner image formed on the photosensitive drum by electrostatic adsorption using an electric field, thereby transferring the toner image onto the printing paper. The transfer roller polarizes the printing paper, making a surface facing the transfer roller positive, and the other surface facing the photosensitive drum negative.

After the toner is transferred, the printing paper successfully separates from the photosensitive drum using its flexural rigidity and separator electrode. The smaller a radius of curvature of the printing paper is, the more easily it can follow a curved surface, and the thicker the printing paper is, the larger its flexural rigidity becomes. In addition, the separator electrode is provided along a printing paper feed path at a subsequent stage of the transfer roller and at a side of the transfer roller. Therefore the printing paper that has been positively charged at the side of the transfer roller after the toner is transferred is attracted to the negative separator electrode, which promotes its separation from the photosensitive drum.

However, photosensitive drum's increased diameter and/or printing paper's reduced thickness have lowered the flexural rigidity of the printing paper. This has made it difficult to separate a printing paper from the photosensitive drum after the transfer process only by the conventional method using an electric charge generated by the separator electrode, whereby the printing paper has easily followed and jammed the photosensitive drum. In particular, if the separator electrode and the printing paper come into contact with each other, the positively charged transfer-roller side of the printing paper reverses its polarity to a negative pole, and the photosensitive-drum side is polarized into a positive pole. Consequently, the paper is attracted to the negatively charged photosensitive drum, and the foregoing problems would be more likely to occur.

BRIEF SUMMARY OF THE INVENTION

Therefore, it is an exemplified general object of the present invention to provide a novel and useful electrophotographic recorded device and transfer method, in which the above disadvantages are eliminated.

Another exemplified and more specific object of the present invention is to provide an electrophotographic recorded device and a transfer method having excellent recorded medium feeding and separating capabilities.

In order to achieve the above objects, an electrophotographic recorded device as one embodiment of the present invention comprises a photosensitive drum that forms a toner image, a transfer roller that applies to a recorded medium transfer voltage so as to transfer the toner image onto the recorded medium, the recorded medium passing through between the photosensitive drum and the transfer roller, and a separator section that is located along a feed path for the recorded medium at a front stage of the transfer roller, and polarizes a surface of the recorded medium facing the photosensitive drum in to the same polarity as that of the photosensitive drum. According to the electrophotographic recorded device, the electrostatic repulsion on a contact surface between the photosensitive drum and the recorded medium makes the post-transfer separation easy.

A transfer method as another embodiment of the present invention comprises the steps of polarizing a surface of the recorded medium facing the photosensitive drum in to the same polarity as that of the photosensitive drum before the recorded medium is conveyed between the photosensitive drum and the transfer roller, and applying a transfer current to the transfer roller so as to transfer a toner image formed on the photosensitive drum onto the recorded medium. This transfer method also provides the same effect as the above electrophotographic recorded medium.

Other objects and further features of the present invention will become readily apparent from the following description of the embodiments with reference to accompanying drawings.

DETAILED DESCRIPTION OF THE INVENTION

Figure 1:
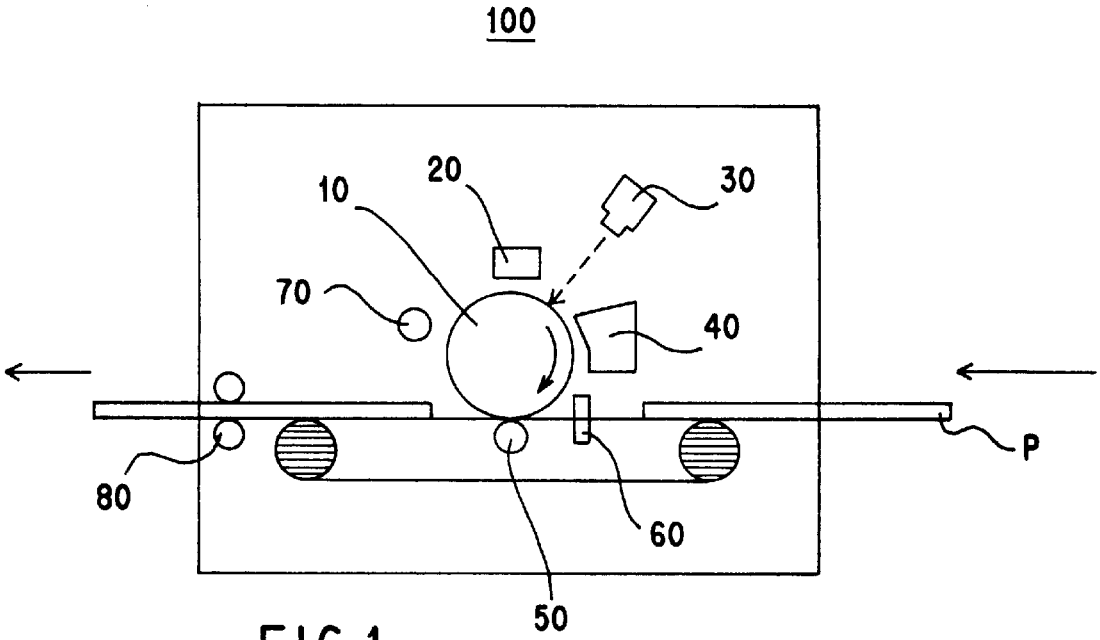
FIG. 1 is a schematic sectional block diagram of an exemplified aspect of an electrophotographic recorded device according to the present invention.

Referring now to FIGS. 1 through 5, a description will be given of an electrophotographic recorded device 100 as one embodiment of the present invention, and its operation process. The same elements are identified by the same reference numerals, and a duplicate description thereof will be omitted. Hereupon, FIG. 1 is a schematic sectional block diagram of the electrophotographic recorded device 100.

Figure 2:
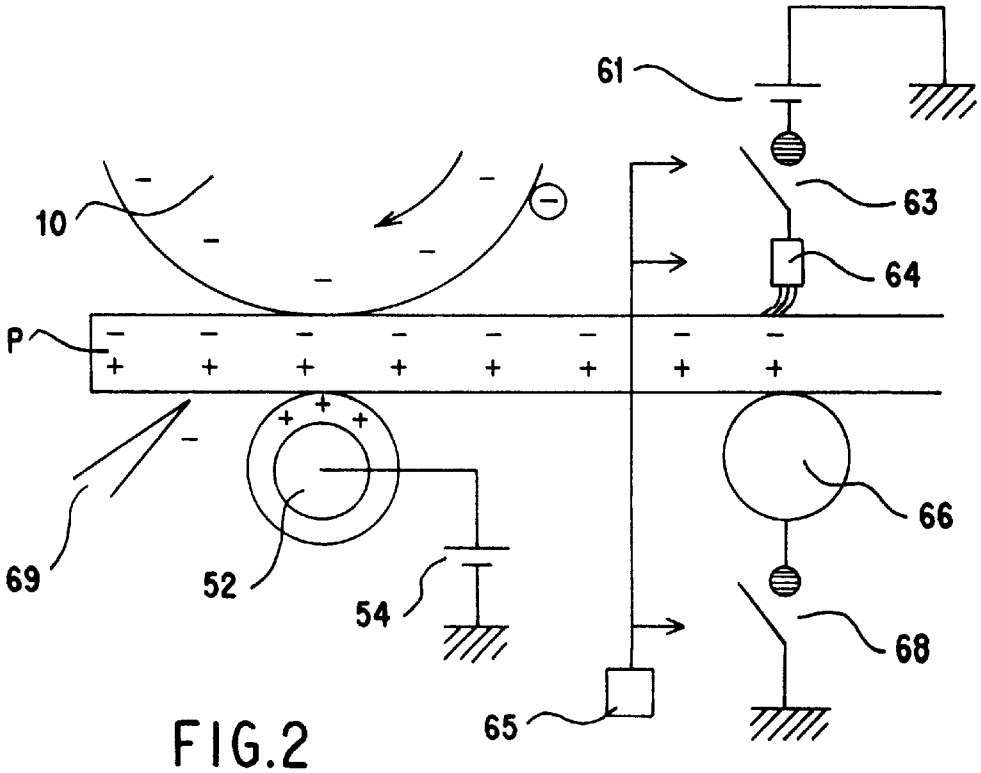
FIG. 2 is a magnified schematic sectional view near a transfer unit of the electrophotographic recorded device shown in FIG. 1 for explaining a polarized state of a recorded medium.
Figure 3:
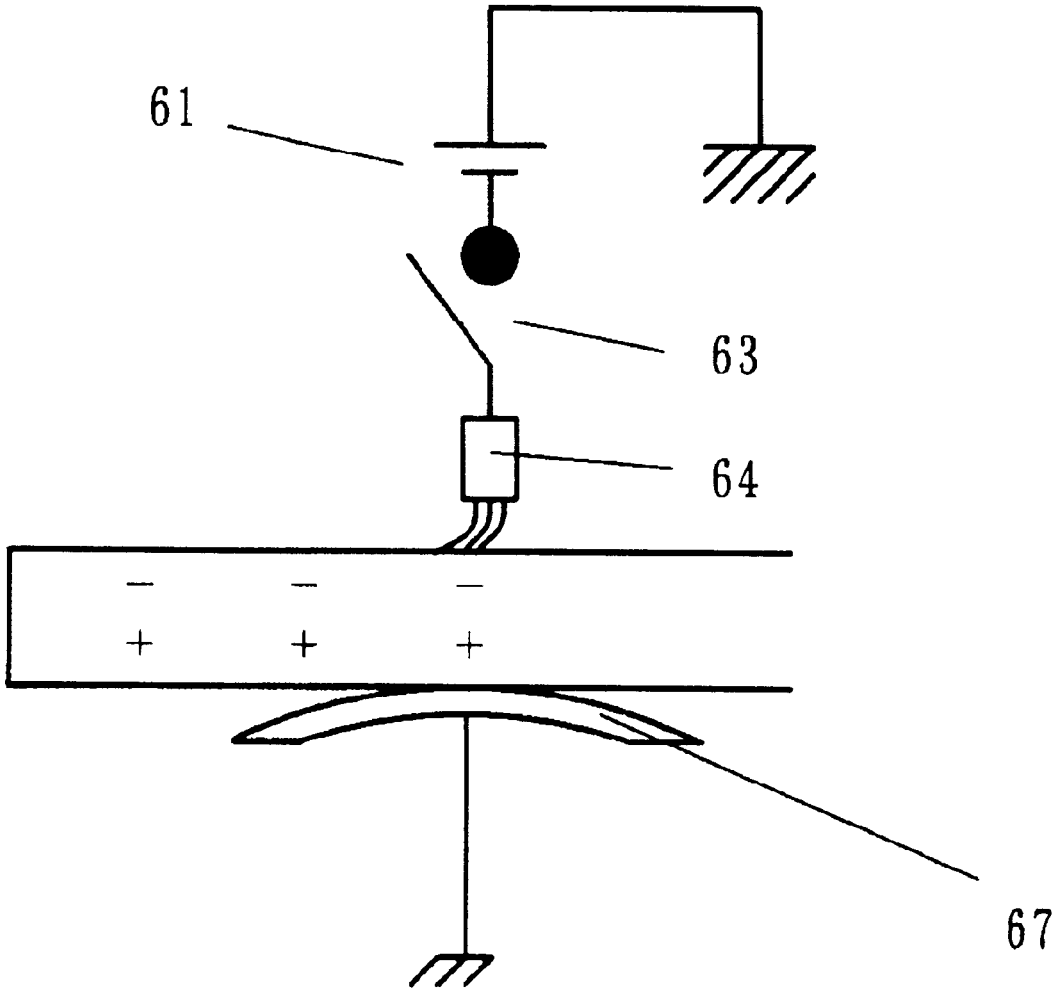
FIG. 3 is a schematic sectional view of a separator section of another embodiment of thictrophotographic recorded device shown in FIG. 2.
Figure 4:
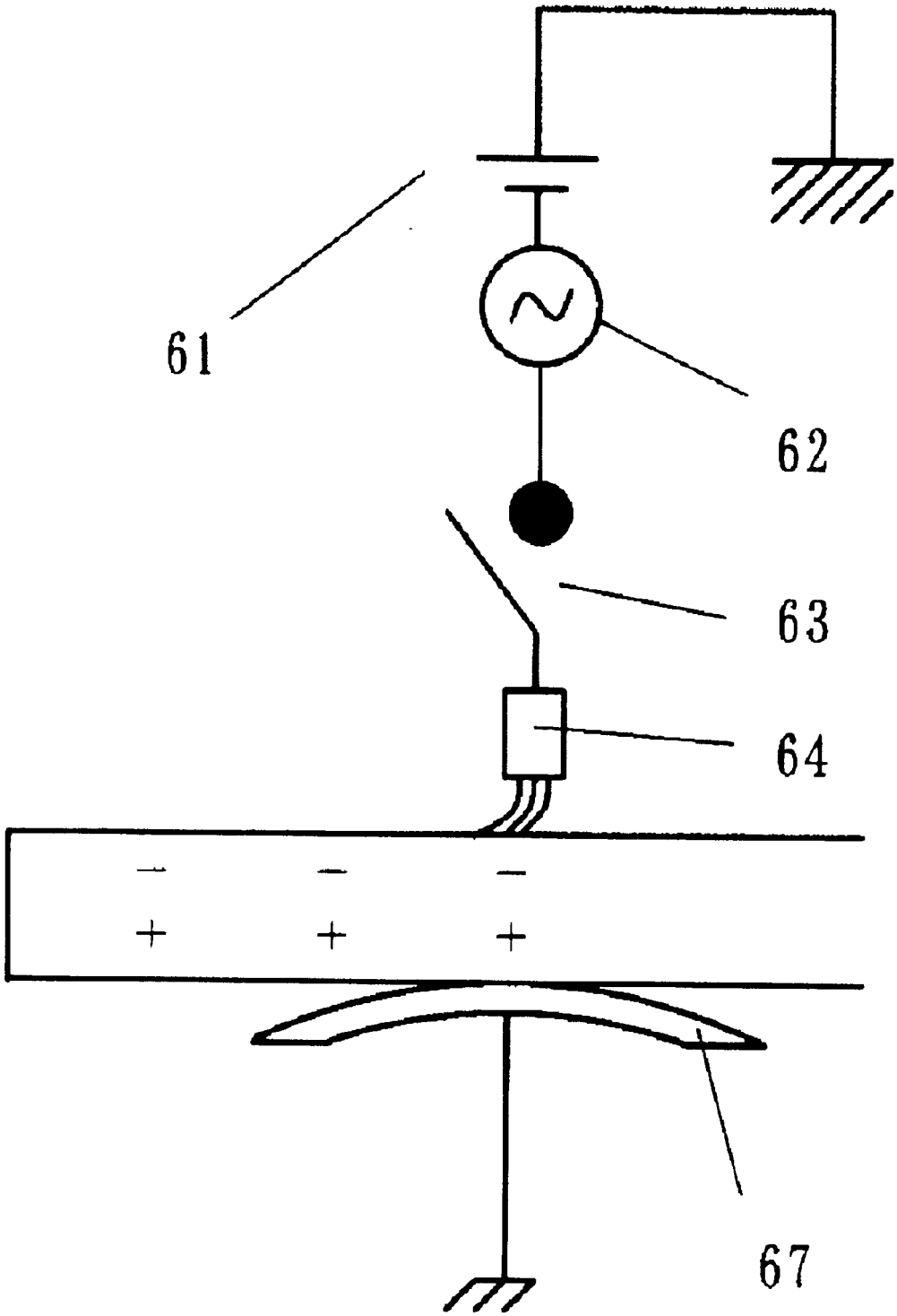
FIG. 4 is a schematic sectional view of a separator section of still another embodiment aspect of the electrophotographic recorded device shown in FIG. 2.

FIG. 2 is a partially enlarged sectional view in the vicinity of a transfer unit 50 for explaining a polarized state of printing paper P as a recorded medium. FIG. 3 is a schematic sectional view of another embodiment of the transfer unit 50 that polarizes the recorded medium. FIG. 4 is a schematic sectional view of still another embodiment of the transfer unit 50 that polarizes the recorded medium.

With reference to FIG. 1, the electrophotographic recorded device 100 comprises a photosensitive drum 10, a charging roller 20, an exposure laser beam generator 30, a development device 40, a transfer unit 50, a separator section 60, a cleaning section 70, and a fixing device 80. The printing paper P is conveyed along a feed path that passes through between the photosensitive drum 10 and the transfer unit 50 (a transfer roller 52 thereof), and a top (or front) surface of the printing paper P comes in contact with the photosensitive drum 10, while its bottom (or rear) surface with the transfer roller 52. The printing paper P is conveyed from the right to the left in FIG. 1.

The photosensitive drum 10 includes a photosensitized dielectric layer on a rotatable drum-shaped conductor support, and used for an image holding member. For instance, the photosensitive drum 10 is made by applying a function separationtype organic photoreceptor with a thickness of about 20 $\mu$m on a drum-shaped aluminum member, and rotates at a circumferential velocity of 70 mm/s to move in the arrow direction at a speed of 30 mm/s.

The charger 20 is a scorotron electrifying device, which has a property of giving a constant amount of electric charges on the photosensitive drum 10. The photosensitive drum can thereby be charged on its surface uniformly at about −700 V. Alternatively, the charger is constituted of a conductive rotary brush. Charging with such a charging brush is performed, for instance, by bringing the brush into direct contact with the photosensitive drum 10 and discharging in an infinitesimal void, while curbing a generation of ozone. The charging brush has fibers arranged densely but minute nonuniformity exists on a portion in contact with the drum, which is likely to cause nonuniform charging as its brushing speed increases; therefore it is preferable to prevent the charge from becoming nonuniform by adjusting its brush rpm (e.g., at 22 rpm), rotation direction (e.g., opposite to the direction in which the photosensitive drum 10 rotates), and contact depth between the brush and the drum.

The exposure laser beam generator 30 has an LED, for example, used as a light source. The light in accordance with an original document exposes the photosensitive drum 10 using an optical system including a mirror and lens that are not shown in FIG. 1. The exposure neutralizes a potential on the photosensitive drum 10 and forms a latent image corresponding to an image data to be recorded.

The development device 40 supplies a fine charged particle of toner from a toner cartridge (not shown), and forms a toner image onto the photosensitive drum 10 by an electrostatic force between the photosensitive drum 10 and the charged toner, thereby visualizing the image. The toner may include one or two components (i.e., including a carrier).

The transfer roller 52, generates an electric field to electrostatically adsorb the toner, and transfers the toner image that has been adsorbed on the photosensitive drum 10, onto the printing paper P utilizing a transfer current. The transfer unit 50 includes a transfer roller 52 constituted of a conductive rubber roller, etc. which applies a voltage from the underside of the printing paper P, and a transfer power supply 54 connected with the transfer roller 52. The transfer power supply 54 gives the transfer roller 52 a charge of the opposite polarity to the toner so as to transfer the toner onto the paper P. A distance between the transfer roller 52 and the photosensitive drum 10 may be adjusted so as to prevent a non-contact with the photosensitive drum 10 by repulsion during the high-speed conveyance, and maintain the transfer without pressing the toner onto the drum 10 too strongly.

The separator section 60 serves to separate from the photosensitive drum 10 the printing paper P that has passed through the transfer unit 50 . As shown in FIG. 2, the separator section 60 includes a DC power supply 61, switches 63 and 68, a charging brush 64, a controller 65, a conductive roller 66, and a separator electrode 69. The separator section 60 may partly or wholly be integrated into a single body. In an example as shown in FIG. 2, the printing paper P is polarized by the charging brush 64 and the conductive roller 66. The polarity on the surface of the photosensitive drum 10 and that on the surface facing the photosensitive drum 10 (i.e., the top surface) of the printing paper P become such the same, as generates electronic repulsion, separating the printing paper P efficiently after the transfer process.

The separator section 60 is connected at one end with the DC power supply 61, and the other end is grounded. In FIG. 2, topside of the printing paper P is connected with the DC power supply 61 and its underside is grounded, but the reverse may be applicable as well. Moreover, as shown in FIG. 4, a driving source may employ both the DC power supply 61 and the AC power supply 62. Driving the rotary brush 64 in a waveform formed by superposing an AC component on a DC component may permit a stable charging without suffering changes in environment or in thickness of a coating of the photosensitive drum 10. Superposing a DC voltage on an AC voltage would converge a charging voltage to the printing paper P upon the DC component, and therefore it is favorable to adjust the DC component between about −20 V and −100 V. The DC power supply 61 may be a constant-voltage power supply or a constant-current source.

The charging brush 64 and the conductive roller 66 are used for dielectric polarization of the printing paper P, and a practicable combination of charging members and conductive members may be selected from the group including, but not limited to, a brush, a roller and a plate, as shown in FIGS. 3 and 4. In FIGS. 3 and 4, the charging brush 64 and the conductive plate 67 are used. The dielectric polarization means a phenomenon in which an external application of an electric field to a dielectric generates a positive charge at one end surface of the dielectric or a positive pole (i.e., positively electrified), and a negative charge at the other end surface or a negative pole (i.e., negatively electrified). As shown in FIG. 2, in general, the roller 66 exhibits a good feeding ability but requires an axle and bearing, while the plate 67 does not require an axle or bearing but exhibits less feeding ability than the roller 66. Thus, a structure may be selected according to its usage. The charging brush 64 has the same structure as the above conductive rotary brush. The charging brush 64 has a specific resistance of 105Ω·cm through 1010Ω·cm, preferably of 107Ω·cm through 108Ω·cm.

The switches 63 and 68 are provided to restrict a dielectric polarization area, period or the like for the printing paper P.

The printing paper P, once its end has separated from the photosensitive drum 10, in general, would not possibly be electrostatically adsorbed again. At high temperature and humidity (e.g., temperature: 30° C., humidity: 80%), the printing paper P, as retaining moisture, may have increased its conductivity, whereby the transfer current may transmit through the paper P into the DC power supply 61 or a ground. As a result, the transfer charges to be applied to the paper P become insufficient, which deprives the paper P of sufficient attraction for the toner, and lowers transfer efficiency, whereby the print would disadvantageously fade or be partly missing. Therefore. the printing paper P is required to terminate the polarization before coming into contact with the photosensitive drum 10, or to be polarized only at edge and then be electrically separated with the above switches. In order to prevent the transfer current from flowing into the power supply or the ground and to keep the printing quality excellent, the switches 63 and/or 68 preferably employ a transistor or a relay that is connectable if necessary.

The controller 65 controls the switches 63 and 68, and, if necessary, a rotary action of the charging brush 64. Alternatively, the charging brush 64 may be provided so as to reciprocate and the controller 65 may control its reciprocating movement. The charging brush 64 may be prevented from being clogged with dust (e.g., toner additive and paper powder). Alternatively, a brush cleaner may be provided to clean a surface of the brush 64, and the controller may control its operation. It is possible to provide a plurality of controllers to control these components individvally. In addition, the controller 65 can also control a transfer current applied to the transfer roller 52 and a voltage applied to the separator electrode that is selectively provided.

The controller 65 controls so as to turn on the switches 63 and 68 from when the edge of the printing paper P passes through the charging brush 64 to when it travels by a predetermined distance. This edge is located out of a recordable (or printable) area, and the predetermined distance is set, for example, within a range of about 2 mm through 20 mm. In order to prevent the printing quality degration, the controller 65 may preferably control the switches 63 and/or 68 so as to terminate the polarization for the paper P before it contacts the photosensitive drum 10 (i.e., to turn the switches off before the edge reaches the photosensitive drum 10).

The separator electrode 69 is selectively provided on the separator section 60. The separator electrode 69 is located along a feed path for the printing paper P at a subsequent stage of the transfer roller 52, and applies a voltage of the same polarity as that of the photosensitive drum 10 to a surface of the printing paper P facing the transfer roller 52. The separator electrode 69 helps the printing paper P separate from the photosensitive drum 10, and can remove charges on the paper P. As its structure and operation is known in the art, a detailed description thereof will be omitted.

After the transfer, the cleaning section 70 collects toner remaining on the photosensitive drum 10, and as necessary, returns the collected toner to the toner cartridge. The cleaning section 70 also serves to prevent dust of paper other than toner from being charged at the development section, bringing about a deleterious effect on a charging condition of toner, and lowering a printing performance. The cleaning section 70 can utilize varied kinds of energy including magnetism and rubber friction.

The fixing device 80 is an apparatus that permanently fixes toner onto the printing paper P. The transferred toner is adhered with a weak force, and thus easily fallen off. Therefore, the toner needs to be fixed by energy such as pressure and heat, and it is necessary to make solid toner into liquid toner in order to obtain a sufficient fixing performance. The added energy makes the solid toner semifluid, spread and penetrand, completing the fixture.

In operation of the recorded device shown in FIG. 1, the photosensitive drum 10 carries a uniform negative charge (at about −700 V) applied by the charger 20. When the laser beam is emitted from the exposure laser beam generator 30 onto the photosensitive drum 10, the uniform charge on the photosensitive drum 10 is partly eliminated by exposure to light with the laser beam, and forms a latent image. Thereafter, the latent image is developed in the development device 40. To be more specific, a charged particle (or powder) of toner at about −50 V is attracted to a dissipated area on the photosensitive drum 10 by the electrostatic force. Consequently, the latent image on the photosensitive drum 10 is visualized as a toner image. The paper P is polarized by the separator section 60, and its surface in contact with the photosensitive drum 10 (top surface in FIG. 2) is charged in the same polarity as the surface of the photosensitive drum 10, whereby the electric repulsion generates. The toner image is transferred onto the printing paper P that has been conveyed to the transfer unit 50 in proper timing. When the printing paper P reaches a transfer position, the transfer unit 50 generates an electric field having a polarity opposite to the toner from a side of the printing paper P opposite to the photosensitive drum 10. Resultantly, the toner image of the photosensitive drum 10 is adsorbed and deposited onto the printing paper P, and thus the toner image is transferred onto the printing paper P. Next, the separator electrode 69 promotes separation of the paper P from the photosensitive drum 10, and discharges the paper P. The cleaning section 70 collects remaining toner on the photosensitive drum 10. The toner on the printing paper P then passes in the fixing device 80, and thereby permanently fixed; thereafter the printing paper P is ejected out of the recorded device 100.

EXAMPLE

In a structure as shown in FIG. 2, a surface of the photosensitive drum 10 and a top surface of the printing paper are negatively charged to generate the electric repulsion between them. In order to measure separation performance between the printing paper P and the photosensitive drum 10, an experiment was conducted as follows. The charging brush 64 had a specific resistance of $10^5\Omega\cdot$cm through $10^{10}\Omega\cdot$cm, preferably of $10^7\Omega\cdot$cm through $10^8\Omega\cdot$cm. The charging voltage at that time was below −1,000 V, preferably −200V through −500 V, and a voltage on the top of the printing paper P indicated −20 V through −100 V. An outrage voltage of the printing paper P can be placed negatively even if its initial voltage is placed positively.

In a first example of the experiment, a constant-voltage control was exercised. To be more specific, a constant-voltage source 61 of −300 V was employed as a drive source. A voltage applied to the transfer voltage was set at +700 V, a separator voltage in the separator electrode 69 at −500 V, and a drum surface potential at −650 V.

In a second example of the experiment, a constant-current control was exercised. More specifically, a charging potential on the top of the paper P was set at −300 V, a transfer current was at +8 $\mu$A, a current that flowed in the separator electrode 69 was at −4$\mu$A, and a drum surface potential at −650 V.

In these two experiments, the printing paper P used thin paper having a base weight of 55 g or lighter and the photosensitive drum 10 had an outer diameter of Ø 30 through Ø 120 mm. The paper P could be separate from the photosensitive drum 10 after the transfer.

Although the preferred embodiments of the present invention have been described above, various modifications and changes may be made in the present invention without departing from the spirit and scope thereof.

As described above, the electrophotographic recorded device and transfer method as one aspect of the present invention enable the printing paper to be successfully separated from the photosensitive drum, preventing jamming. Accordingly, the present invention is suitable particularly for an electrophotographic recorded device that employs a relatively thin printing paper and a photosensitive drum having a relatively large diameter.

What is claimed is:

1. An electrophotographic recorded device comprising:

a photosensitive drum that forms a toner image;

a transfer roller that applies to a recorded medium a transfer voltage so as to transfer the toner image onto a recordable area on a surface of the recorded medium, the recorded medium passing through between said photosensitive drum and said transfer roller; and a grounded separator section that contacts the recorded medium, and polarizes and charges an edge in an area out of the recordable area on the surface of the recorded medium into the same polarity as that of said photosensitive drum.

2. The electrophotographic recorded device according to claim 1, wherein said separator section is located on a feed path for the recorded medium at a subsequent stage of said transfer roller, and includes a separator electrode that applies a voltage of the same polarity as that of photosensitive drum to a surface of the recorded medium facing said transfer roller.

3. The electrophotographic recorded device according to claim 1, wherein said separator section includes:

a switch; and a controller that controls said switch so as to turn said switch on from when an edge of the recorded medium passes through said separator section to when the recorded medium moves by a predetermined distance.

4. The electrophotographic recorded device according to claim 3, wherein an area starting from the edge by the predetermined distance of the recorded medium is out of a recordable area on the recorded medium.

5. The electrophotographic recorded device according to claim 3, wherein said controller controls said switch so as to turn said switch off before the edge reaches said photosensitive drum.

6. The electrophotographic recorded device according to claim 3, wherein said controller controls said switch so as to turn said switch off after the recorded medium is charged from the edge by the predetermined distance.

7. The electrophotographic recorded device according to claim 1, wherein said separator section includes a DC power supply and a AC power supply.

8. The electrophotographic recorded device according to claim 1, wherein said separator section includes:

a DC power supply;

a first member that is connected with said DC power supply and selected from a group consisting of a conductive brush, a conductive roller, and a conductive plate; and a second member that is opposite to said first member via the recorded medium, said second member being selected from said group and grounded.

9. The electrophotographic recorded device according to claim 8, wherein said first member has a specific resistance of $10^7$ through $10^8 \Omega \cdot cm$.

10. A method of transferring a recorded medium, comprising the steps of:

polarizing and charging an edge in an area out of a recordable area on a surface of a recorded medium facing a photosensitive drum into the same polarity as that of said photosensitive drum by contacting the recorded medium before the recorded medium is conveyed between said photosensitive drum and a transfer roller; and applying a transfer current to said transfer roller so as to transfer a toner image formed on said photosensitive drum onto the recordable area on the surface of said recorded medium.

11. The method of transferring a recorded medium according to claim 10, wherein said polarizing step is targeted only at an edge out of the recordable area on the recorded medium.

12. The method of transferring a recorded medium according to claim 10, further comprises the step of applying a voltage into the same polarity as that of said photosensitive drum at a surface of the recorded medium facing said transfer roller after said applying step.

* * * * *